US005878457A

United States Patent [19]

Cox et al.

[11] Patent Number: 5,878,457

[45] Date of Patent: Mar. 9, 1999

[54] CORELESS LINT-REMOVING TAPE ROLL

[75] Inventors: Sheila F. Cox, St. Paul; Thomas L. Wood, Maplewood, both of Minn.

[73] Assignee: Minnesota Mining and Manufacturing Company, St. Paul, Minn.

[21] Appl. No.: 810,155

[22] Filed: Feb. 25, 1997

[51] Int. Cl.[6] ..... A47L 25/00

[52] U.S. Cl. ..... 15/104.002; 428/40.1; 428/43; 428/906

[58] Field of Search ..... 15/104.002; 428/40.1, 428/43, 906

[56] References Cited

U.S. PATENT DOCUMENTS

| | | | |
|---|---|---|---|
| D. 247,143 | 2/1978 | Rivas | D4/137 |
| D. 273,058 | 3/1984 | McKay | D4/122 |
| D. 273,059 | 3/1984 | McKay | D4/122 |
| D. 276,763 | 12/1984 | McKay | D4/122 |
| D. 295,833 | 5/1988 | Roth | D9/337 |
| 1,960,137 | 5/1934 | Brown | 428/906 X |
| 2,269,712 | 1/1942 | Drew | 15/104.002 X |
| 2,401,842 | 6/1946 | Slater | 15/104.002 |
| 2,624,060 | 1/1953 | McKenzie | 15/104.002 |
| 2,702,913 | 3/1955 | Walkama | 15/104.002 |
| 2,724,847 | 11/1955 | Krasno | 15/104.002 |
| 2,800,215 | 7/1957 | Converse | 15/104.002 X |
| 3,013,367 | 12/1961 | Sarre | 53/520 |
| 3,066,043 | 11/1962 | Hechtman et al. | 428/906 X |
| 3,201,815 | 8/1965 | Selby | 15/104.002 |
| 3,231,918 | 2/1966 | Marks | 15/104.002 |
| 3,299,461 | 1/1967 | Marks | 15/104.002 |
| 3,342,325 | 9/1967 | Dreher | 206/400 |
| 3,343,194 | 9/1967 | Ramelson | 15/104.002 |
| 3,346,105 | 10/1967 | Nye et al. | 428/906 X |
| 3,363,276 | 1/1968 | Thomas, Jr. | 15/105 |
| 3,389,416 | 6/1968 | Timms | 15/104.002 |
| 3,417,418 | 12/1968 | Ribound | 15/104.002 |
| 3,421,170 | 1/1969 | Thomas, Jr. | 15/104.002 |
| 3,623,179 | 11/1971 | Roth | 15/104.001 |
| 3,675,274 | 7/1972 | Fried et al. | 428/906 X |
| 3,742,547 | 7/1973 | Sohmer | 15/104.002 |
| 3,770,542 | 11/1973 | Hall et al. | 156/184 |
| 3,823,887 | 7/1974 | Gerstein | 242/521 |
| 3,899,075 | 8/1975 | Hall et al. | 206/411 |
| 4,297,403 | 10/1981 | Smith | 428/42.3 |
| 4,361,923 | 12/1982 | McKay | 15/104.002 |
| 4,399,579 | 8/1983 | McKay | 15/104.002 |
| 4,422,201 | 12/1983 | McKay | 15/104.002 |
| 4,427,726 | 1/1984 | Wolfrum | 428/43 |
| 4,522,870 | 6/1985 | Esmay | 428/906 X |
| 4,570,280 | 2/1986 | Roth | 15/104.002 |
| 4,727,616 | 3/1988 | Kucera et al. | 15/104.002 |
| 4,783,015 | 11/1988 | Shimizu | 242/160.1 |
| 4,807,825 | 2/1989 | Elsner et al. | 242/524 |
| 5,027,465 | 7/1991 | McKay | 15/104.002 |
| 5,388,300 | 2/1995 | Hickey | 15/104.002 |
| 5,407,716 | 4/1995 | Mitchell | 428/40.1 |

FOREIGN PATENT DOCUMENTS

| | | |
|---|---|---|
| 8421443 | 11/1985 | Germany . |
| 8804854 | 5/1988 | Germany . |

*Primary Examiner*—Mark Spisich
*Attorney, Agent, or Firm*—Charles D. Levine

[57] ABSTRACT

A linerless, coreless roll of tape includes a backing layer having an adhesive layer formed on one side. The tape is formed into a roll having a plurality of wraps with the adhesive side facing outwardly. The tape is sufficiently stiff and self-supporting to obviate the need for support material, and the entire roll, including the last wrap, is completely usable for its intended purpose without wasting any tape. As lint removal tape, the tape is used while it is still on the roll, and the tape is removed from the roll only after use, to discard it. The roll can be sufficiently compressible to create a plane of contact during use to remove lint. The roll of tape can be mounted on an applicator.

1 Claim, 2 Drawing Sheets

CORELESS LINT-REMOVING TAPE ROLL

TECHNICAL FIELD

The present invention relates to tape rolls. More particularly, the present invention relates to coreless tape rolls used for lint removal.

BACKGROUND OF THE INVENTION

Most rolls of tape are used by first removing a length of tape from the roll before using the tape for its intended purpose. One use for tape while still on a roll is lint removal. Lint removal tape is used to remove lint and other small particles from fabric, such as clothing. Lint removal tape can be used in individual sheets, whether individually packaged or removed from a roll or a pad. Lint removal tape can also be used while in roll form with the tape still on the roll. The tape is removed from the roll only after use, to discard it.

In roll form, lint removal tape is typically wound on a core with the adhesive side of the tape wound outwardly for use. A roll of lint removal tape is placed on an applicator, which typically is formed of a handle portion and a tape-receiving portion. The roll is placed on the tape-receiving portion. Various forms of lint removal tape rolls are known, such as those described in U.S. Pat. No. 5,027,465 and U.S. Pat. No. 5,388,300.

Coreless rolls of tape and methods for their manufacture are known. For example, U.S. Pat. Nos. 3,770,542 and 3,899,075 disclose coreless tape rolls. The tape rolls formed, however, are linered and the liner performs the functions of a core.

U.S. Pat. No. 4,297,403 discloses another linered coreless roll of tape. In order to use this roll, the innermost portions of tape are not useable and must be discarded.

U.S. Pat. No. 3,823,887 discloses a method of winding thin tissue paper into a roll without a core. However, there is no suggestion of how such a coreless roll of thin paper could be used. Also, this roll is free of adhesive or similar substances.

Also, generally, these known coreless rolls are used by removing a portion of tape from the roll before using the tape for its intended purpose. There are no known coreless rolls of tape in which the tape is used while it is still on the roll, and the tape is removed from the roll only after use, to discard it. There is a need for a linerless, coreless roll of tape in which all of the tape is usable, the tape is used while it is still on the roll, and the tape is removed from the roll only after use, to discard it.

SUMMARY OF THE INVENTION

A linerless, coreless roll of tape includes a backing layer having a first side and a second side and an adhesive layer formed on the first side of the backing layer. The tape is formed into a roll having a plurality of wraps with the adhesive side facing outwardly by rolling the tape on only itself. When forming a roll, the tape is sufficiently stiff and self-supporting to obviate the need for support material, and the entire roll, including the last wrap, is completely usable for its intended purpose without wasting any tape.

The second side of the backing layer can include a low adhesion backside layer. Also, the tape can be perforated to permit the exterior wrap of tape to be removed.

As lint removal tape, the tape is used while it is still on the roll, and the tape is removed from the roll only after use, to discard it. The roll can be sufficiently compressible to create a plane of contact during use to remove lint.

The roll of tape can be used with an applicator which includes a handle portion and a tape-receiving portion. The last wrap of tape directly contacts the tape-receiving portion of the applicator such that when the last wrap of tape is removed, the applicator can be replenished with another roll of tape.

DETAILED DESCRIPTION

Figure 1:
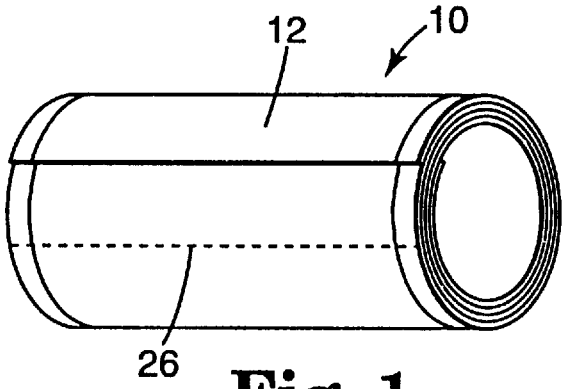
FIG. 1 is a perspective view of a roll of tape of the present invention.
Figure 2:
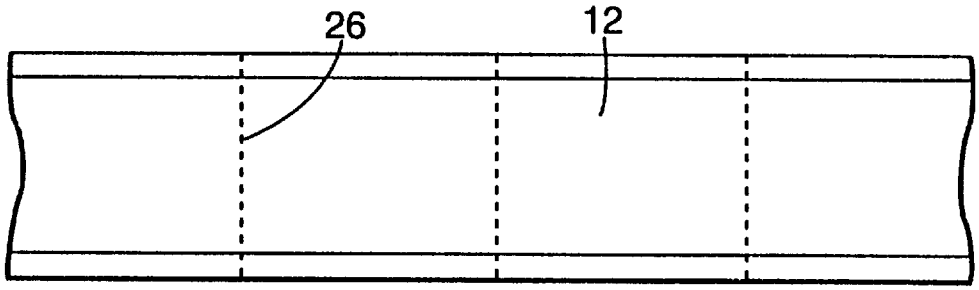
FIG. 2 is a top view of a portion of tape.
Figure 3:
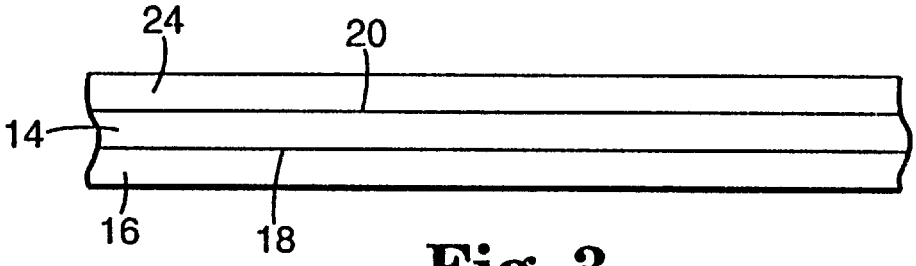
FIG. 3 is a side view of the tape of FIG. 2.

FIGS. 1–3 shows a linerless, coreless roll 10 of lint removal tape 12. The tape itself is formed of at least two layers, a backing layer 14 and an adhesive layer 16 and can be made from any known materials. The backing layer 14 has a first side 18 and a second side 20 and can be made of, for example, paper or plastic film. Suitable paper backings include saturated flatstock and crepe. Suitable plastic film backings include polypropylene, polyethylene, copolymers of polypropylene and polyethylene, polyesters, and vinyl acetates. The polypropylene can be biaxially oriented polypropylene (BOPP) or simultaneously biaxially oriented polypropylene (SBOPP). The backing material can be compostible or degradable, can be colored, can be printed, and can be of different surface textures or embossed.

As best shown in FIG. 3, the adhesive layer 16 is formed on the first side 18 of the backing layer 14. It can be formed on the entire first side, or the backing layer can be uncoated by adhesive along one or both side edges. Alternatively, the side edges can be adhesive coated and then detackified by using waxes, lacquers, or inks for example.

The adhesive can include hotmelt-coated formulations, transfer-coated formulations, solvent-coated formulations, and latex formulations. Adhesives useful in the preparation of lint removal tape 12 according to the present invention include all pressure sensitive adhesives. Pressure sensitive adhesives are normally tacky at room temperature and can be adhered to a surface by application of, at most, light finger pressure. Examples of adhesives useful in the invention include those based on general compositions of polyacrylate; polyvinyl ether; diene-containing rubber such as natural rubber, polyisoprene, and polyisobutylene; polychloroprene; butyl rubber; butadiene-acrylonitrile polymer; thermoplastic elastomer; block copolymers such as styrene-isoprene and styrene-isoprene-styrene block copolymers, ethylene-propylene-diene polymers, and styrene-butadiene polymer; poly-alpha-olefin; amorphous polyolefin; silicone; ethylene-containing copolymer such as ethylene vinyl acetate, ethylacrylate, and ethyl methacrylate; polyurethane; polyamide; epoxy; polyvinylpyrrolidone and vinylpyrrolidone copolymers; polyesters; and mixtures of the above. Additionally, the adhesives can contain additives such as tackifiers, plasticizers, fillers, antioxidants, stabilizers, pigments, diffusing particles, curatives, and solvents.

A general description of useful pressure sensitive adhesives may be found in *Encyclopedia of Polymer Science and Engineering*, Vol. 13, Wiley-Interscience Publishers (New York, 1988). Additional description of useful pressure sensitive adhesives may be found in *Encyclopedia of Polymer Science and Technology*, Vol. 1, Interscience Publishers (New York, 1964).

The tape 12 is formed into a roll 10 having a plurality of wraps with the adhesive layer 16 facing outwardly by rolling the tape on only itself. No support material, such as a core, a liner, or any other material that could lend support and provide rigidity and strength to the roll of tape, is necessary. In the illustrated embodiments, none is used.

The roll 10 of lint removal tape can be used by placing the roll 10 on an applicator 30 (see FIGS. 4–6), which typically is formed of a handle portion 32 and a tape-receiving portion 34. The roll 10 is placed on the tape-receiving portion 34.

When forming a roll 10, the tape 12 is sufficiently firm, stiff, and self-supporting to obviate the need for support material. The entire roll 10, including the last wrap, is completely usable for its intended purpose of lint removal without wasting any tape. The last wrap of tape directly contacts the tape-receiving portion 34 of the applicator 30 such that the last wrap of tape is completely useable. The last wrap generally contacts the tape receiving portion 34 along at least one axial line but need not contact the tape receiving portion circumferentially. When the last wrap of tape is removed, the applicator 30 can be replenished with another roll 10 of tape. With the roll of tape of this invention, there is no risk that any of the tape could adhere to the applicator 30 and either impair the operation of the applicator or waste tape. Also, there is no core which must be removed before replenishing with a new roll of tape.

The coreless roll 10 of tape could also include a third layer. A low adhesion backside (LAB) layer 24 can be formed on the second side 20 of the backing layer 14 to facilitate removing the outer wrap of tape from the roll 10 after that wrap of tape has been used and is to be discarded. Suitable LAB layers include silicones, fluorochemicals, acrylates, and polyvinylacetates. Numerous other layers can be added to the tape such as primers to increase the adhesion of adhesive layer 16 to backing layer 14. Also, printed material can be located on the first side of the backing layer under the adhesive, or on the second side of the backing layer either under or over any LAB layer 24. This printed material can be advertising, instructions, or other information. Also, the tape could contain deodorants, perfumes, antistatic materials, and encapsulated cleaning chemicals. Also, the backing layer 14 can be modified such as by flame treatment, corona treatment, and roughening.

Another optional feature of the tape can be perforations 26, as shown in FIG. 2, to facilitate removing the outer wrap of tape from the roll 10 after that wrap of tape has been used and is to be discarded. The perforations 26 can be made before the tape 12 is rolled into a roll 10 or after the roll has been formed. Also, the perforations 26 on successive wraps can be located at the same or different circumferential locations on the roll 10. Alternatively, after the tape 12 is formed into a roll 10, a complete cut (not shown) can be formed through the roll to create discrete sheets and to facilitate removal of the outer wrap of tape. The complete cut could extend across the roll except for the edges or across the entire roll except for the innermost wraps.

In addition to reducing waste, the coreless feature of this invention provides a performance advantage. By eliminating any core, liner, or other backing support material, the roll is more compressible (not having any rigid support to compress). The roll is sufficiently compressible to create a plane of contact during use to remove lint. This creates a larger area on the tape to remove and receive lint. This compressibility is sufficient even when the tape is used on an applicator.

In making one embodiment of this invention, a master roll of 10 cm (4 in) wide tape has an embossed polypropylene backing, a low adhesion backside (LAB) coating on one side, and a hot melt coated adhesive coating across the other side leaving uncoated edges approximately 0.62 cm (0.25 in) wide. The master roll is formed and wound in a conventional manner. The master roll is then rewound, adhesive side out, and is optionally perforated. A vacuum pulls the tape onto a mandrel during this stage and holds it in place while the appropriate length of tape is wound with the adhesive side out and converted to a coreless roll of the proper length. A turret indexes the finished wound tape. As the turret rotates, the vacuum on the original mandrel is discontinued to allow the coreless roll of tape. A second mandrel moves into place, the vacuum connects, and the process is repeated. Additional mandrels can be used, as necessary, to facilitate continuous operation.

Figure 4:
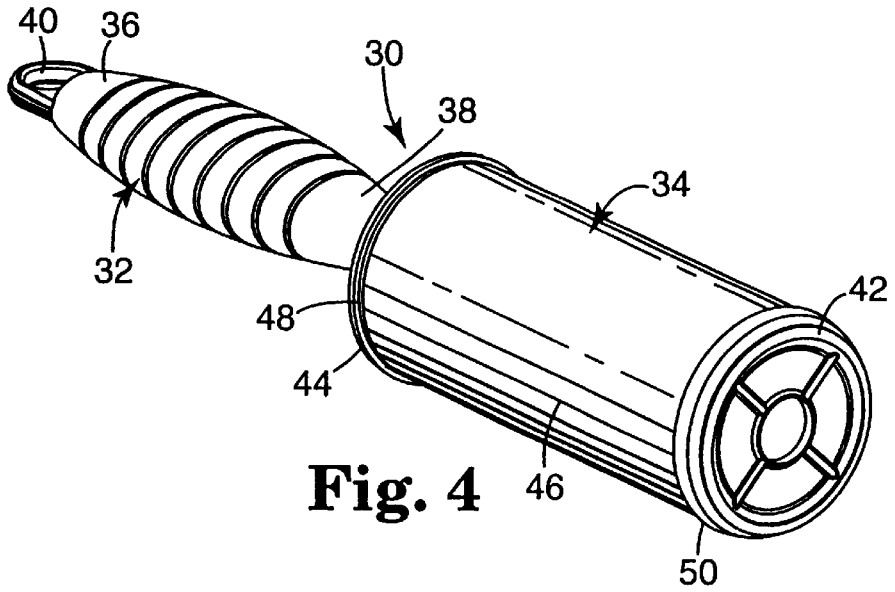
FIG. 4 is a perspective view of the applicator of the present invention.
Figure 5:
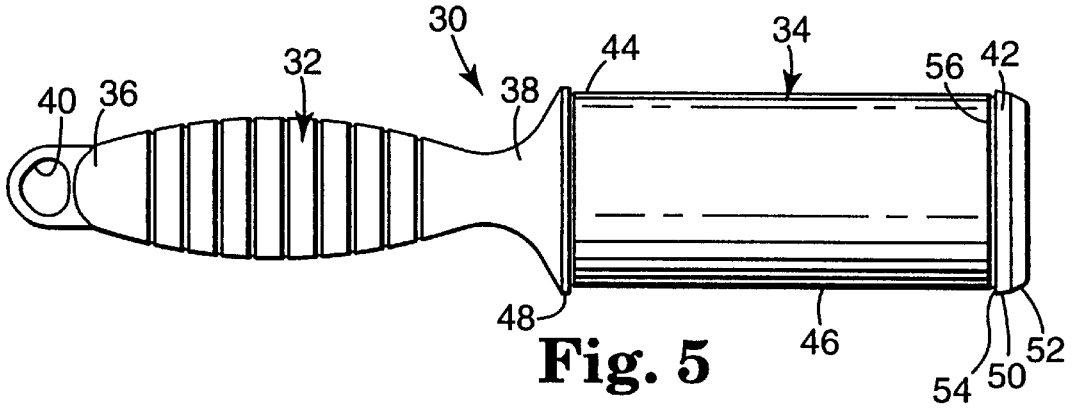
FIG. 5 is a side view of the applicator of FIG. 4.
Figure 6:
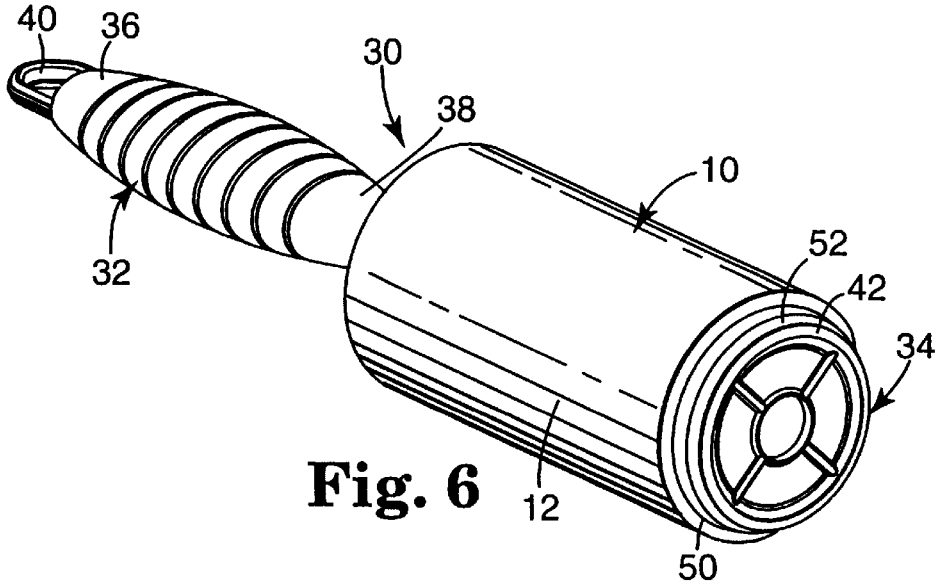
FIG. 6 is a perspective view of the roll of tape mounted on the applicator.

The invention is also a lint removal device which includes the coreless roll 10 of tape 12 and the applicator 30. As shown in FIGS. 4–6, the applicator 30 includes the handle portion 32 and the tape-receiving portion 34. Blow molding, injection molding, and other manufacturing methods can allow for a one piece construction which is simple to make and low in cost. The handle portion 32 can have any shape and can be contoured to ergodynamically fit a hand. The handle portion 32 has a free end 36 and a connecting end 38. The free end 36 can have an opening 40 to permit hanging the applicator 30 on a hook for storage.

The tape-receiving portion 34 also includes a free end 42 and a connecting end 44. The connecting end 38 of the handle portion 32 is connected to the connecting end 44 of the tape-receiving portion 34. The tape-receiving portion 34 also includes a cylindrical tape-receiving surface 46, an inner lip 48 adjacent the connecting end 44, and an outer lip 50 adjacent the free end 42. Both lips 48, 50 extend radially beyond the tape-receiving surface 46. The outer lip 50 has a tapered portion 52 on the side facing the free end 42 of the tape-receiving portion 34. The outer lip 50 can be perpendicular to the tape-receiving portion 34 on the side 54 facing the handle portion 32. After a roll 10 of tape traverses over the outer lip 50, it is locked in place on the tape-receiving surface 46 and cannot be removed by sliding it back over the outer lip 50.

Because the tape roll 10 is coreless and is stretchable, it can be stretched over the slightly oversized and tapered outer lip 50, which can optionally be compressible and flexible. Once the roll 10 is in place, the tape recovers to its original size and resides in the recessed area of the tape-receiving surface 46 (between the inner lip 48 and the outer lip 50) which is slightly oversized to allow seating of the roll 10 of tape. The inner and outer lips can have notches 56 on the inside to hold the tape roll in place so that the tape roll cannot be removed except by dispensing the total roll (or compressing the outer lip 50). The notch 56 prevents the tape roll 10 from bending upward over the outer lip 50. The notch causes the tape roll 10 to bend into the notch when forced forward the outer lip 50 and retains the tape 12. A typical roll on a fiber core could not be used in this roller design due to its inflexible core.

The applicator 30 could be used with a cored tape roll only if the core is compressible. However, the compressible core would remain on the tape-receiving portion 34 after the tape is completely dispensed. The applicator would consequently not be reusable unless the core was cut off. Combination with a coreless tape allows for easy reuse.

Various changes and modifications can be made in the invention without departing from the scope or spirit of the invention. For example, the tape can be used for purposes other than lint removal. Also, the tape-receiving surface need not be cylindrical. It could be formed of planar or curved sides meeting in edges which assist in holding the tape roll in position.

We claim:

1. A lint removal device comprising:

an applicator comprising a handle portion and a tape-receiving portion, wherein the handle portion has a free end and a connecting end; the tape-receiving portion has a free end and a connecting end wherein the handle portion connecting end is connected to the tape-receiving portion connecting end, and wherein the tape-receiving portion further comprises:

a cylindrical tape-receiving surface;

an inner lip adjacent the handle portion which extends radially beyond the tape-receiving surface; and an outer lip adjacent the free end and which extends radially beyond the tape-receiving surface, wherein the outer lip is tapered on the side facing the free end of the tape-receiving portion, and after a roll of tape traverses over the outer lip it is locked in place on the tape-receiving surface and cannot be removed by sliding it back over the outer lip; and a linerless, coreless roll of tape mounted on the tape-receiving portion of the applicator and comprising a backing layer having a first side and a second side, and an adhesive layer formed on the first side of the backing layer, wherein the tape is formed into a roll having a plurality of wraps with the adhesive side facing outwardly by rolling the tape on only itself, such that, when forming a roll, the tape is sufficiently stiff and self-supporting to obviate the need for support material, and such that the entire roll, including the last wrap, is completely usable for its intended purpose of lint removal without wasting any tape, wherein the linerless, coreless roll of tape is stretchable, and can be stretched over the outer lip such that once the roll is in place, the tape recovers into the tape-receiving portion to allow seating of the roll of tape.

* * * * *